United States Patent [19]

Beuther et al.

[11] Patent Number: 4,541,916

[45] Date of Patent: Sep. 17, 1985

[54] COAL LIQUEFACTION PROCESS USING LOW GRADE CRUDE OIL

[75] Inventors: Harold Beuther, Vero Beach, Fla.; Thaddeus P. Kobylinski, Prospect, Pa.; Win-Chung Lee, Parkersburg, W. Va.; Bruce K. Schmid, Littleton, Colo.

[73] Assignee: Gulf Research & Development Corporation, Pittsburgh, Pa.

[21] Appl. No.: 662,357

[22] Filed: Oct. 18, 1984

[51] Int. Cl.[4] ..... C10G 1/00; C10G 47/00

[52] U.S. Cl. ..... 208/8 LE; 208/107

[58] Field of Search ..... 208/8 LE, 107

[56] References Cited

U.S. PATENT DOCUMENTS

| | | | |
|---|---|---|---|
| 3,369,994 | 2/1968 | Slater et al. | 208/107 X |
| 4,032,428 | 6/1977 | Johnson | 208/8 |
| 4,035,281 | 7/1977 | Espenscheid et al. | 208/8 |
| 4,054,504 | 10/1977 | Chervenak et al. | 208/10 |
| 4,077,866 | 3/1978 | Owen et al. | 208/9 |
| 4,081,351 | 3/1978 | Heinemann | 208/8 LE |
| 4,111,786 | 9/1978 | Sergumia et al. | 208/8 LE |
| 4,151,066 | 4/1979 | Yan et al. | 208/8 |
| 4,159,236 | 6/1979 | Schmid | 208/10 |
| 4,159,238 | 6/1979 | Schmid | 208/10 |
| 4,250,014 | 2/1981 | Long et al. | 208/8 |
| 4,252,633 | 2/1981 | Long et al. | 208/8 |
| 4,264,428 | 4/1981 | Schoennagel et al. | 208/8 |
| 4,317,711 | 3/1982 | Yon | 208/8 LE |
| 4,338,182 | 7/1982 | Vernon et al. | 208/8 LE |
| 4,347,117 | 8/1982 | Bauman et al. | 208/8 LE |
| 4,364,817 | 12/1982 | Anderson et al. | 208/8 LE |
| 4,372,838 | 2/1983 | Kulik et al. | 208/8 LE |
| 4,415,429 | 11/1983 | Stadelhofer et al. | 208/8 LE |
| 4,422,922 | 12/1983 | Rosenthal et al. | 208/3 LE |

FOREIGN PATENT DOCUMENTS

| | | |
|---|---|---|
| 58703 | 5/1977 | Japan . |
| 96003 | 8/1978 | Japan . |
| 25407 | 2/1980 | Japan . |
| 73781 | 6/1980 | Japan . |
| 73780 | 6/1980 | Japan . |

OTHER PUBLICATIONS

Conn et al., "Conversion of Coal to Oil and Gas", SCOPE, 77:11-20 (1981).

Patmore, et al., "Residuum and Heavy Oil Upgrading with the Canmet Hydrocracking Process", *Symposium on Residuum Upgrading and Coking,* AChS, Meeting, Mar. 29-Apr. 3, 1981.

Kotowski et al., "Catalytic Liquefaction of Coal with Crude Oil Residues", Petrochemie Vereinight Mit Brennstoff-Chemie, 33:526-528 (1980).

Granoff, et al., "Mineral Matter Effects in Coal Liquefaction", *Coal Processing Technology,* V:15-18 (1979).

Qader, "Catalytic Hydrosolvation Process Converts Coal to Low-Sulfur Liquid", *Energy Sources,* 3:323-337 (1978).

Schmid, et al., "Recycle SRC Processing for Liquid and Solid Fuels", 85th Meeting of AIChE, Philadelphia, PA, Jun. 4-8 (1978).

Lee, et al., "The Selectivity of Coal Minerals as Catalysts in Coal Liquefaction and Hydrodesulfurization", ACS Division of Fuel Chem., vol. 22, No. 6, p. 120, Presented at Chicago, Ill., Aug. 29-Sep. 2, 1977.

Granoff, et al., "Mineral Matter Effects in Coal Liquefaction", ACS Division of Fuel Chem., vol. 22, No. 6, pp. 183-193, Presented at Amer. Chem. Soc. National Meeting, 174th, Chicago, Ill., Aug. 29-Sep. 2, 1977.

*Primary Examiner*—D. E. Gantz

*Assistant Examiner*—William G. Wright

*Attorney, Agent, or Firm*—Buell, Ziesenheim, Beck & Alstadt

[57] ABSTRACT

A process for converting coal to liquid hydrocarbonaceous products involving a liquefaction reaction in the presence of a coal derived recycle slurry and a non-coal derived solvent comprising a hydrocarbonaceous oil or distillation bottom residue thereof intrinsically contaminated with greater than 300 ppm total of vanadium and nickel. The liquefaction reaction is performed under hydrogen pressure (approximately 500-4000 psi) and under elevated temperature (approximately 300°-500° C.) using a weight ratio of non-coal derived solvent to coal of about 1/1 or less. The conversion of coal to liquids is greatly enhanced by the use of such a non-coal derived solvent under these conditions.

11 Claims, 2 Drawing Figures

COAL LIQUEFACTION PROCESS USING LOW GRADE CRUDE OIL

BACKGROUND OF THE INVENTION

This invention relates to a process for converting solid carbonaceous materials such as coal into liquid hydrocarbonaceous products. More particularly, this invention relates to an improved process to effect hydrogenation of coal to provide hydrocarbonaceous liquids suitable for use as substitutes for petroleum liquids.

Liquefaction of coal and similar solid carbonaceous materials is known as a method for producing hydrocarbonaceous liquids. A liquid product from liquefaction conversion operations may be substituted for petroleum fuels and be refined to produce gasoline, etc., in a manner analogous to that used to refine petroleum. Because of the abundance of coal reserves and decreasing petroleum resources, it is becoming increasingly important to develop practical methods for deriving petroleum substitutes from coal.

In a typical operation for solvent liquefaction of coal, the coal is pulverized and mixed with a hydrocarbonaceous solvent. The mixture of coal and solvent, generally with added hydrogen gas, is subjected to heat and pressure. The solid to liquid conversion reaction involves the hydrogenation and hydrocracking of the various unsaturated hydrocarbon molecules of coal to effect an increase in the ratio of hydrogen to carbon. As the ratio of hydrogen to carbon increases for any given molecule the hydrocarbon molecule becomes more liquid and less viscous. Typically, coal exhibits an average hydrogen to carbon ratio of 0.8, that is 0.8 hydrogen atom per carbon atom. In the liquefaction process there is an attempt to increase this hydrogen to carbon ratio to about 1.0 or 1.2.

Since the coal to be liquified is relatively low in hydrogen content it is necessary to add a significant amount of hydrogen to the coal during the liquefaction operation. The prior art has devised several methods for facilitating the necessary hydrogen addition involved in the conversion reaction. Of these, the most commonly suggested method has involved the use of extrinsic catalysts in combination with a hydrogen-donor solvent.

The use of catalyst additives has been found to be generally very expensive. These catalysts rapidly become poisoned by the metals present in the coal, and are quite difficult to separate from the solid residue remaining after the extraction operation.

Hydrogen-donor solvents have also provided a partial solution to the problem of transferring hydrogen into the coal. These solvents such as creosote oil, petroleum middle oil, tetralin and coal derived process solvent, serve to donate hydrogen to the coal molecules and simultaneously revert from a partially saturated to a more aromatic structure. However, the amount of hydrogen that hydrogen-donor solvents may typically transfer into the coal is quite limited, and further hydrogenation treatment subsequent to the liquefaction operation is sometimes necessary to regenerate the hydrogen-donor solvent. It addition, some hydrogen-donor solvents which have been used in the past in a technically feasible manner have been quite economically infeasible. For example, tetralin has been used in the past as a hydrogen-donor source for the conversion of coal solids to liquid materials. Although tetralin has proved to be a good hydrogen-donor source the cost is prohibitive, considering that tetralin is in itself a highly refined petroleum product. Recycle of coal slurry derived from the process has offered a significant advance in reducing the costs associated with coal liquefaction and conserving the intrinsic catalytic activity of coal ash.

Although some of the prior art liquefaction procedures have been successful under certain conditions, the need remains for other practical and inexpensive solutions to the long felt problems concerned with coal liquefaction. Consequently, the need especially exists for a hydrogen-donor solvent with intrinsic catalytic properties to supplement the catalytic effect of coal ash.

SUMMARY OF THE INVENTION

The present invention relates to a process for the conversion of coal solids to hydrocarbonaceous liquid products wherein low grade hydrocarbonaceous oil or its distillation residue serves both as hydrogen-donor and supplemental catalyst source.

In its broadest aspect the process comprises reacting together particulate coal and a hydrogen-donor hydrocarbonaceous, non-coal derived solvent (sometimes termed extraneous hydrogen donor solvent herein) which intrinsically contains catalytically effective amounts of the metal contaminants, vanadium and nickel. The reaction proceeds in the absence of an externally added catalyst source, under hydrogen pressure and elevated temperature for a period of time sufficient to convert a portion of the solid particulate coal to gaseous and liquid hydrocarbonaceous products. Because of the catalytic effect of the metals in the hydrogen-donor solvent and because of its capability for hydrogen transfer, no external catalyst is required to facilitate hydrogen transfer to the coal compounds or to rejuvenate the hydrogen-donor solvent capacity.

Moreover, in the recycle system wherein coal derived process solvents and ash are recycled with new introduced coal, the use of the hydrogen donor solvent in proper proportions as proposed by the present invention augments the catalytic conversion contributed by the recycle coal products but without significantly diluting the recycle components.

The present invention contemplates the hydrogenation of a particulate coal in the presence of vanadium and nickel contaminated hydrocarbonaceous oils or their distillation residues from non-coal sources including petroleum crude oil, tar sands, shale oil, or bitumens. The process proceeds under hydrogen pressures ranging from 500 to 4000 psi and temperatures desirably ranging from about 300° C.–500° C., preferably above 450° C. Further in accordance with the invention, the ratio of non-coal derived solvent/coal is desirably about 1/5 to about 1/1 to promote enhanced liquid yield from the solid coal.

The low grade hydrocarbonaceous oil or its distillation residue provides an inexpensive combined hydrogen donating and intrinsic catalyst source to facilitate efficient liquefaction operation. Typically the hydrogen donor solvent of the present invention is intrinsically contaminated with greater than 300 ppm total of nickel plus vanadium. It is desirable however to employ solvents contaminated with substantially more than 30 ppm nickel and 300 ppm vanadium. Because the coal ash and extraneous hydrogen donor source of this invention each contribute to the catalytic activity necessary to maintain desirable conversion rates, the conversion reactions proceed in the absence of external catalyst sources. Therefore there is no need for utilization of a commercial hydrogenation catalyst additive such as Co-Mo-Al catalysts.

DETAILED DESCRIPTION OF THE PREFERRED EMBODIMENT

Figure 1:
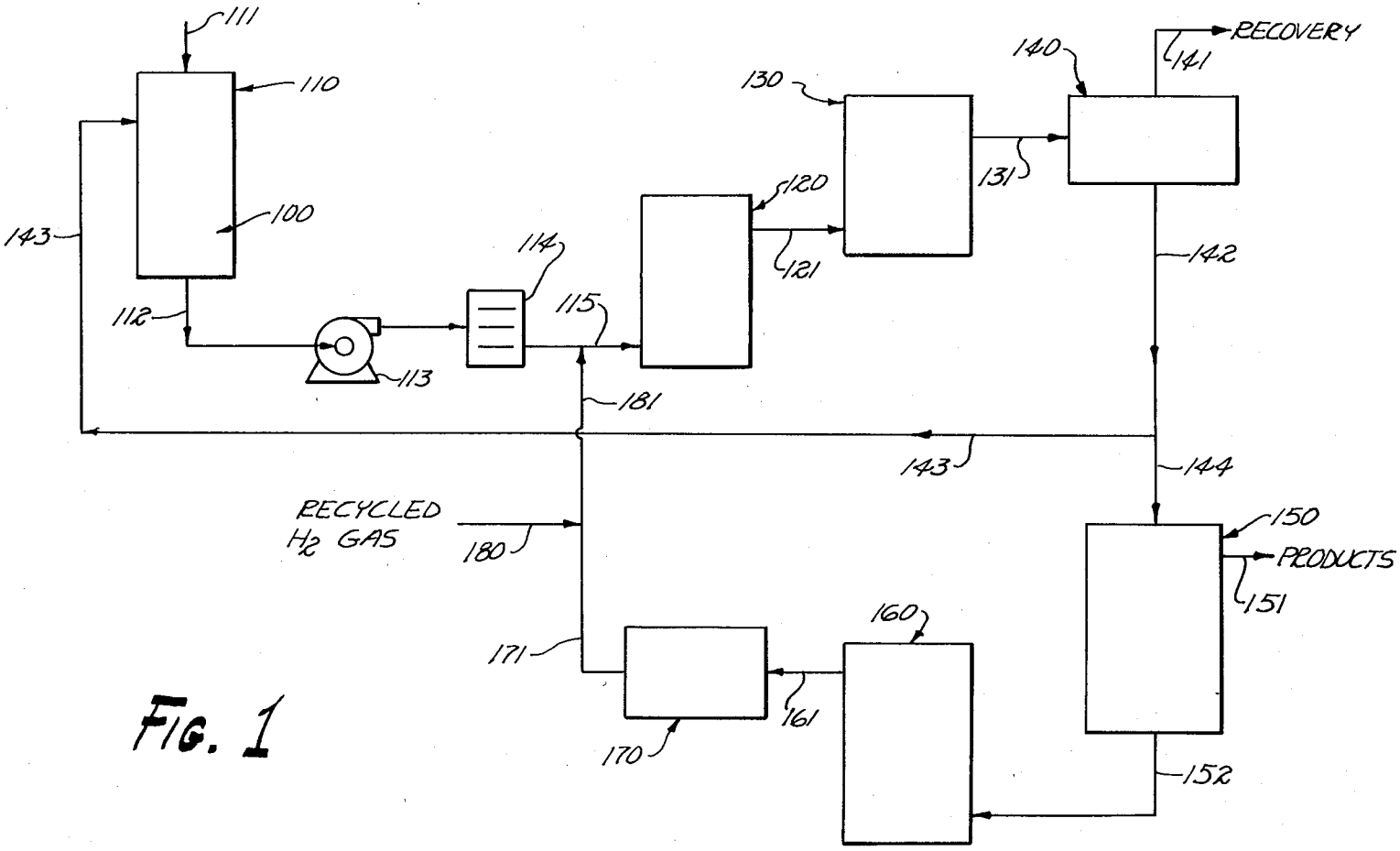
FIG. 1 is a schematic diagram of an integrated coal liquefaction-gasification process.

Solid coal materials which may be liquified in the process of the present invention include, in general, bituminous and sub-bituminous coal, lignite, and peat, and the like materials from naturally-occurring carbonaceous deposits.

According to the present invention, the non-coal derived hydrogen-donor solvent is a fluid selected from aromatic low grade hydrocarbonaceous fluids intrinsically contaminated with a catalytically effective amount of vanadium and nickel. These fluids furnish diverse hydrogen containing materials which are capable of transferring or donating hydrogen to coal molecules under reduced hydrogen pressure. Generally, the low grade hydrocarbonaceous oils and distillation residues exhibit on the average a relatively high hydrogen to carbon atomic ratio, on the order of 1.4 to 1.8. Moreover the non-coal derived hydrogen donor solvents of this invention can be characterized as having at least 50% by weight residuum boiling over 600° F.

In addition, such solvents are currently very inexpensive since they are highly asphaltic and contain a high percentage of sulfur and metal contaminants, principally iron, vanadium (on the order of greater than 300 ppm), and nickel (on the order of greater than 30 ppm) which render the fluid foul for combustion purposes. However, for the purposes of the present invention such mineral contaminants, in particular vanadium and nickel, are desirable components of the solvent.

The vanadium and nickel contaminants provide catalyst activity which facilitates the transfer of hydrogen from the solvent to the coal molecules. Typically heretofore, such low grade hydrocarbonaceous oils or their distillation residues were considered difficult and expensive to handle in conventional refining processes into useful petroleum products. The present invention offers the dual advantages of utilizing both low grade hydrocarbonaceous oils or residuum and low cost coal sources, which each independently is cost ineffective to refine, to effect high concomittant reactivity and production of useful liquid and gaseous hydrocarbon products derived from each source.

For purposes of illustrating the invention, applicants have employed a whole crude known in the industry as Ceuta crude and a residuum fraction from the same crude. Ceuta crude is a Venezuelan crude having high sulfur and metal levels and a substantial quantity of high boiling cyclic compounds capable of transferring hydrogen. In particular, the Ceuta crude used in the following experiments contained 1.28% (w/w) sulfur, 19 ppm nickel, and 142 ppm vanadium. Moreover, the Ceuta crude has the following distillation profile:

| Distillation (%) | Ceuta Crude Temperature (°F.) |
|---|---|
| 5 | 212 |
| 10 | 270 |
| 20 | 352 |
| 30 | 471 |
| 40 | 563 |
| 50 | 653 |
| 60 | 689 |
| 70 | cracked at 704° F. |

A particularly preferred hydrogen-donor solvent for the purposes of this invention is the residue from atmospheric distillation refining of crude petroleum, commonly referred to as atmospheric tower bottoms.

In the examples which follow, ATB-Ceuta Crude was employed as the hydrogen donating solvent for coal liquefaction experiments. ATB-Ceuta Crude is an atmospheric tower bottoms fraction of Ceuta Crude. Elemental analysis of ATB-Ceuta Crude provided an atomic H/C ratio of 1.60; 2.4% (w/w) sulfur; 38 ppm nickel; and 327 ppm vanadium. Cushman distillation profile indicates on the average 33.3% (w/w) heavy distillate (HD); 66.6% (w/w) solids free residue; 0.1% (w/w) insoluble organic matter (IOM).

Another petroleum distillation residue which may be implemented as a hydrogen-donor solvent source is vacuum tower bottoms. However, the vacuum tower bottoms are quite viscous and require a lower viscosity recycle slurry to form a pumpable feed slurry. Further, the molecules making up the vacuum tower residues are more condensed and less reactive with respect to hydrogen-donor activity.

A preferred embodiment of the present invention is illustrated by a continuous recycle operation. A particularly preferred continuous recycle operation is described more fully in U.S. Pat. Nos. 4,159,238 and 4,159,236 issued to Schmid, the teachings of which are incorporated herein by reference.

A. Continuous Recycle Operation

A very brief description of the process as depicted in FIG. 1 indicates the source of the recycle slurry stream 143 blended with the introduced raw pulverized coal 111. In addition there is an inlet means 110 for the introduction of the extraneous hydrogen donor source. Within mixing zone 100 the recycle slurry, raw coal, and extraneous hydrogen donor source are maintained in agitation to provide a pumpable, uniform consistency slurry. The feed slurry output 112 from slurry mixing zone 100 is pumped by circulation pump 113 to charge pump 114, which in turn raises the pressure of the slurry to near 2,000 psi (140 kg/cm$^2$) for feeding to preheater 120. The total preheater feed 115 to preheater 120 is the feed slurry pumped from charge pump 114 combined with hydrogen gas 181. In preheater 120, the total preheater feed 115 is heated to an outlet temperature of from 680° F. to 870° F. (360° C. to 440° C.). The preheater effluent 121 goes directly into reactor 130 where heat released by exothermic hydrogenation and hydrocracking reactions raises the temperature to the range of 800° F. to 900° F. (427° C. to 482° C.). From reactor 130 the reaction stream goes to a vapor/liquid separation system 140. Gases and light liquid products 141 are removed for further separation and recovery. The slurry 142 from the vapor/liquid separation system 140, having been reduced in pressure in passing through vapor/liquid separation system 140, is split into two streams. One stream 143 is recycled to the slurry mixing zone as solvent for the process.

Slurry stream 144, the other stream of the two streams into which slurry 142 is split, is fed to distillation system 150 from which liquefaction products 151 are obtained. The bottoms stream 152 from distillation system 150 is used as feed to a gasifier 160 where a synthesis gas is produced. At least a portion 161 of this synthesis gas is converted in shift reaction 170 to provide hydrogen stream 171. This hydrogen stream 171 is then combined with hydrogen gas 180 recycled from the light product recovery system 140.

In the typical coal liquefaction process, recycle slurry stream 143 is lean in middle distillate, i.e., liquids boiling between 380° F. (193° C.) and 600° F. (316° C.) because a substantial portion of those liquids are flashed off during pressure letdown. Recycle slurry 143 is rich in heavy distillates, i.e. liquids boiling between 600° F. (316° C.) and about 900° F. (482° C.), in normally solid dissolved coal boiling at temperatures in excess of 900° F. (482° C.) (SRC), and in mineral residue. The mineral residue, comprised of inorganic material and undissolved organic material, should be present in the recycle slurry in an amount of 5% at a minimum, preferably at least 10% and most preferably 10% to 20%.

To further illustrate the invention, applicants have performed several laboratory experiments. The examples which follow, which should not be considered as limiting the invention but rather only as exemplary of various embodiments, are based on those laboratory results.

B. Batch Operation

In the Examples I–VIII typical bituminous coals are batch reacted with distillation crude bottom residues under operating conditions of 350° C. to 400° C. and 700 psi $H_2$.

EXAMPLE I

Blacksville-II coal was pulverized to a fine powder, less than 200 mesh (U.S. Sieve Series). Elemental analysis of Blacksville-II coal reveals on average 71.10 wt % carbon; 5.22 wt % hydrogen; 1.55 wt % nitrogen; 7.11 wt % oxygen; 3.08 wt % sulfur and 11.94 wt % ash. ATB-Ceuta atmospheric tower bottom was used as a hydrogen-donor solvent and admixed with the particulate coal prior to reaction.

The coal feed was admixed with the ATB-Ceuta crude on a one to one weight ratio. Before placing the mixture into the reactor, it was stirred manually to help mix the reactants and then warmed to a temperature of about 50° C. to increase the sample fluidity. The slurry was then introduced into a 300 cc autoclave reactor (Autoclave Engineers, Inc., Erie, Pa.). After pouring the slurry samples into the reactor, the reactor system was flushed with hydrogen three times to 50 psi in order to evacuate air from the vessel. The reactor was sealed and pressurized with hydrogen to give an initial "cold" pressure of 350 psi. Next the slurry materials within the reactor vessel were heated to a temperature of about 350° and maintained at this temperature and the resulting hydrogen pressure of about 700 psi for approximately one hour residence time. At the end of this residence period, the heat provided to the reactor vessel was discontinued and the reactor contents were allowed to cool to ambient temperature. One hundred milliliters of toluene was pumped into the cooled reactor to enhance recovery of the soluble liquid material. The solid residue matter was separated from the liquids, by filtration from the liquids placed in a Soxhlet thimble and treated with toluene and tetrahydrofuran (THF) sequentially to extract all remaining soluble materials. The residue coal solids were then dried in an oven and weighed. Experimental conditions and results of all Examples I–VIII are summarized in Table I.

EXAMPLE II

Example I was repeated, except that tetralin (obtained from Fisher Scientific, Co.) was employed as the hydrogen-donor solvent. The coal solids and solvent were admixed in a one to one weight ratio.

EXAMPLE III

As a control experiment, pulverized coal alone was introduced into the reaction vessel without addition of a hydrogen-donor solvent. The remaining experimental conditions, hydrogen pressure temperature and residence time, were the same as those expressed in Example I.

The results of this experimental run are reported in Column III of Table I.

EXAMPLE IV

The reaction operation of Example I was repeated, however, the ratio of coal solid to ATB-Ceuta crude solvent was altered. In this example, the coal solid to ATB-Ceuta crude solvent ratio was one to three on a weight/weight (w/w) basis. Correspondingly, a lower initial "cold" pressure of hydrogen was necessary to fill the reaction vessel. The initial hydrogen pressure introduced was 300 psi.

The reaction conditions then proceeded in the same manner as Example I, involving an operating pressure of 700 psi and a temperature of 350° C. for a one hour residence time.

Results are reported in Column IV of Table I.

EXAMPLE V

Example IV was repeated using tetralin as the H-donor solvent at a one to three coal solid to solvent ratio (w/w). Again the initial hydrogen pressure was 300 psi which subsequently reached 700 psi after heating the reaction vessel to 350° C.

After a one hour residence time, the reactant contents were analyzed and data listed in Column V of Table I.

EXAMPLE VI

Example I was repeated except that the reaction temperature was maintained at 400° C. The liquefied products derived from this run using ATB-Ceuta Crude increased slightly relative to reaction at 350° C. The results are reported in Column VI of Table I.

EXAMPLE VII

Example II was repeated at the higher reaction temperature of 400° C. As indicated by the results noted in Column VII of Table I, increasing temperature dramatically enhances liquefaction yield when tetralin is used as a hydrogen-donor source. This is not surprising since tetralin is a widely used hydrogen-donating solvent for laboratory experimental evaluation.

EXAMPLE VIII

Example III was repeated as a control model at 400° C. The results listed in Column VIII of Table I indicate increasing the reaction temperature enhances liquefaction yield as would be expected when compared to the control data obtained in Example III.

From the results tabulated, it is evident that at high solvent to coal ratios, higher amounts of coal are liquefied when reacted with tetralin as compared to ATB-Ceuta crude solvent. An excess of tetralin gives better results at higher solvent/coal ratios probably due to a combination of strong hydrogen donating activity and additional solvation effect.

An overall examination of the data indicates an increase in temperature conditions enhances the liquefaction yield, while increasing the ratio of non-coal derived solvent/coal from 1/1 to 3/1, has little effect in enhancing the liquid yield. In view of tetralin experiments, however, it would be expected that an increase in solvent/coal ratio would significantly affect the liquid yield. But as the data indicates, the Ceuta crude solvent does not follow the trend as would be predicted from the tetralin data.

Furthermore, the results of using a ratio of ATB-Ceuta Crude/coal of 1/1 or greater at these conditions do not show any unexpected advantages. Moreover, increasing the ratio of non-coal derived solvent/coal in these experiments was less effective than using tetralin as a solvent source.

C. Continuous Operation

EXAMPLE IX

A set of six runs was carried out to determine what effect atmospheric tower bottom residues derived from Ceuta crude would have on product yields from a typical coal liquefaction process employing slurry recycle. A fraction of the process solvent was replaced with atmospheric tower bottoms to serve as an alternate hydrogen-donor solvent source for the conversion of solid coal to liquid and gaseous hydrocarbonaceous products.

The coal used was a Pittsburgh seam coal from the Powhatan No. 6 mine, containing 10.85% ash on a dry basis. Both the recycle slurry (RS) and process solvent (PS) used in all runs were obtained from pilot plant operation on a typical coal liquefaction process under steady state recycle operation, using Powhatan No. 6 coal. They were analyzed by Cushman distillation before use. The process solvent contained 30.11% middle distillate (MD) and 69.89% heavy distillate (HD), while the recycle slurry contained 2.20% MD, 39.05% HD, 41.62% normally solid dissolved coal (SRC), 5.45% insoluble organic matter (IOM) and 11.68% recycle ash.

Elemental analysis of Powhatan No. 6 coal shows 71.94 wt % carbon; 5.10 wt % hydrogen; 1.05 wt % nitrogen; 4.34 wt % sulfur; 6.42 wt % oxygen; 11.05 wt % ash, including about 2 wt % iron, trace nickel, and no detectable vanadium.

Figure 2:
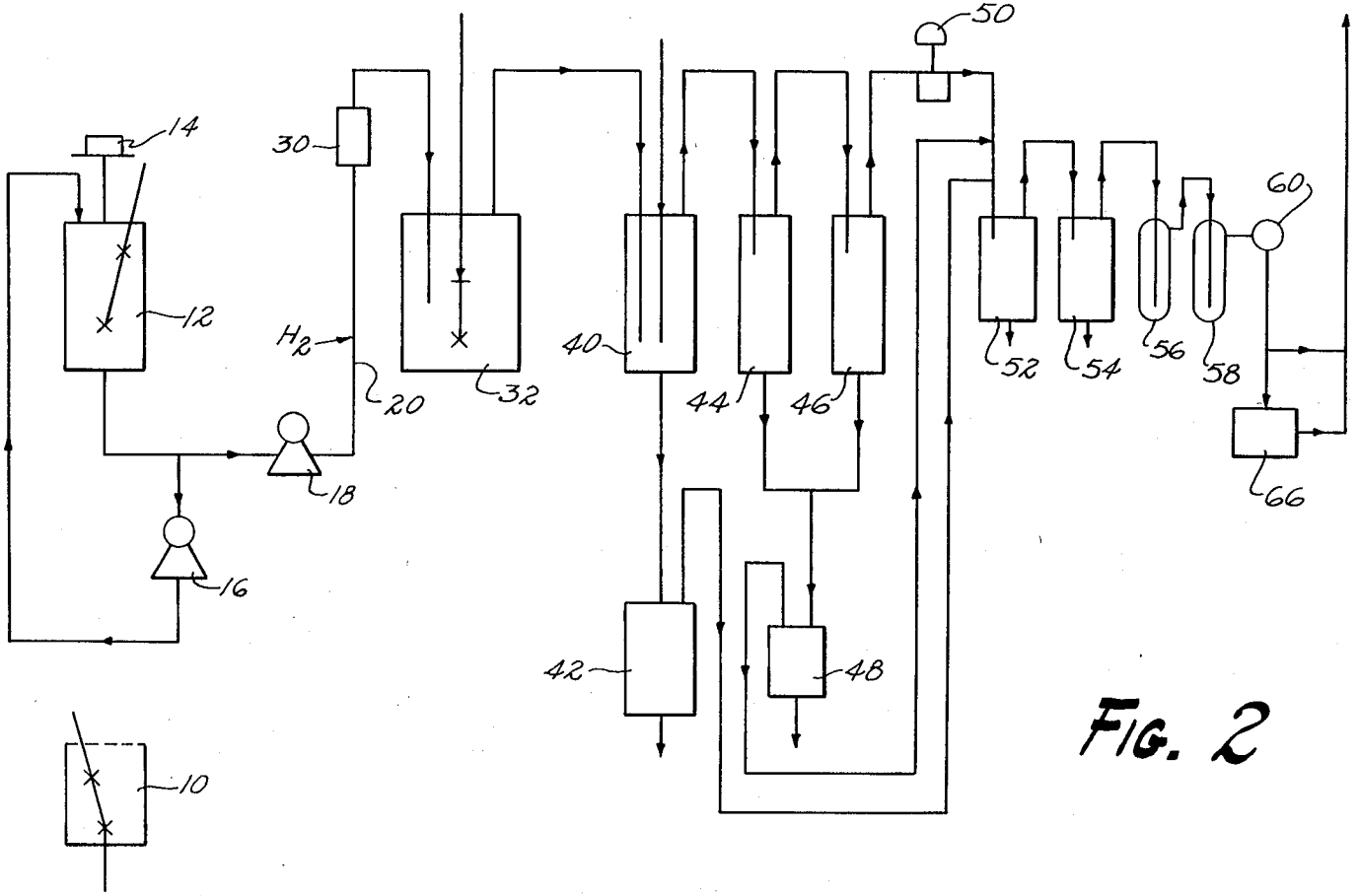
FIG. 2 represents a schematic of a continuous operation process mode of a coal liquefaction unit adapted to utilize the processes of the present invention.

All runs were done in a continuous laboratory unit (see FIG. 2 for schematic). Reaction conditions were 455° C., 2000 psi $H_2$ pressure one hour residence time, and 30.0 wt % coal in the feed slurry.

Referring now to FIG. 2, there is represented a schematic of the continuous mode operation useful in the conversion of solid coal to liquid hydrocarbon products.

The continuous mode operation comprises four main subsystems: (a) slurry feeding, (b) gas metering, (c) preheater and reactor, and (d) reactor effluent separation. Each subsystem is described below.

Slurry Feeding

At the start of the operation, the desired feed blend is formulated batchwise in the mixer 10. The feed blend typically contains pulverized coal, a heavy recycle slurry, middle and heavy distillates useful as process solvents and a low grade crude oil hydrogen source. After the formation of a well mixed slurry, the slurry mixture is pumped at a uniform rate to the feed tank 12. The feed tank 12 is equipped with an agitator and baffle to keep the blend well mixed. A screw pump 16, located beneath the feed tank, provides slurry feed to a high pressure, reciprocating Hills-McCanna pump 18. In addition, the screw pump sustains a constant slurry recirculation of a portion of the slurry feed back to the feed tank. The rate of slurry feed introduced to the reciprocating pump is determined by observing the weight loss of the slurry feed from the feed tank with time. The feed tank is suspended from a weight cell 14 to facilitate this weight differential measurement.

Gas Metering

A continuous supply of hydrogen gas is introduced into the system through a series of high pressure regulators, needle valves and rotometers which accomplish the desired operating pressure. The hydrogen gas is introduced to the system at juncture 20. At this juncture the system is equipped with a positive displacement gauge for determining feed $H_2$ gas flow rate at operating pressure. Pressure of $H_2$ is monitored at several locations throughout the unit, for example, at the $H_2$ inlet at juncture 20, the preheater inlet and outlet, reactor outlet, and at the separator system. Inlet $H_2$ gas calibrations are made before and checked after each experimental run.

Reactor System

After mixture of the hydrogen gas and slurry feed the reaction mixture is pumped through preheater 30. The preheater 30 is a stainless steel tube which is segmentally wrapped for heating and is split into four sections. The preheater wrapping is segmented in such a way as to provide a constant nominal slurry residence time in the preheater independent of the reaction slurry residence time. In a preferred reaction, hydrogen pressure is introduced at approximately 2000 psi and the preheater effects a system temperature of about 450°-500° C. The desirable operable conditions range from 500-4000 psi hydrogen and 300°-500° C. After the slurry feed has been brought up to system temperature, the slurry feed is introduced in a continuous fashion to the reactor system 32. The reactor system 32 is a one liter continuously stirred reactor tank. The reactor tank is constructed with stainless steel. Within the reactor tank the slurry feed is subjected to vigorous mixing while maintained at uniform operation temperature, whereby a homogeneous slurry mixture is maintained without solid accumulation at the bottom of the reactor vessel.

Reactor Effluent Separation

As the slurry feed is reacted under the desired operation temperature and hydrogen pressure, the reaction effluent products are separated into two fractions by a high temperature-high pressure separator 40. Initially, two fractions are obtained: the heavy product (slurry underflow) which contains the product solids, and an overhead vapor stream containing hydrocarbon liquids, water, and gaseous products. The level of effluent in the high temperature-high pressure separator 40 is controlled by sequentially opening and closing two high pressure let down valves leading to pressure separators 44 and 46 and collecting the heavy product in a heavy product collector vessel 42. The overhead vapor stream is further cooled in two low temperature-high pressure separators 44 and 46. The low temperature-high pressure separators effect additional separation of oil into liquid products and condensation of water. The liquid products condensed in separators 44 and 46 are drained into light oil collector 48.

Product gases remaining in the low temperature-high pressure separators are vented through a high pressure, low volume control valve 50 wherein the pressure of the product gases is reduced to nearly atmospheric pressure. The gases are further cooled and the condensed liquids are removed by passage through two water condensors 52 and 54. The vapors from both the heavy product collector 42 and the light oil collector 48 are also vented to water condensors 52 and 54 to recover the condensible material. The second condensor 54 employs a 16 foot long coil type heat exchanger to effect removal of substantially all condensible material. The remaining gases are then vented through a series of ice traps 56 and 58.

The solid materials collected in heavy product collector 42 comprise solvent refined coal, inorganic material, and ash. Light oil accumulating in collectors 48, 52 and 54 is drained periodically to recover the various hydrocarbonaceous liquids.

The product gas flow exiting the ice traps is monitored with a dry test meter 60. A slip stream of the product gas is taken for onstream gas chromatographic analysis and density determination. The gas analysis is performed with an automated gas chromatograph 66 equipped with a dual thermal conductivity detector and flame ionization detector.

Referring now to Table II, Run 1 is a baseline run, involving 30.0% coal, 50.9% recycle slurry (RS), and 19.1% process solvent (PS). The feed slurry composition for this run and all other runs in this example are shown in Table II. Run 6 is a run with 100% ATB-Ceuta crude as a feedstock. The product yield of this run was assumed as the product distribution of the crude in calculating the coal conversion yields in Runs 2, 3, 4, and 5.

In order to prevent any coke formation, the preheater exit temperature in Run 6 was kept at a lower temperature (350° C.) than the rest of the runs. Although the overall material balance of this run was 98.4%, the temperature difference between the two thermocouples inside the reactor was about 32° C., which might mean coke formation inside the reactor. The coke formation was not very serious and did not cause any plug during the five hours off-stream and six hours on-stream operations in the B6 unit. The liquid yields obtained in this run represent upper limits, and would decrease and IOM would increase if coke formation actually occurred inside the reactor. Since the product yield of this run was assumed as the product distribution of the ATB-Ceuta crude in calculating the coal conversion yields in Runs 2, 3, 4 and 5, the coal conversion yields thus obtained would represent the lower limits for each run.

All product yields are also shown in Table II. They were calculated on a moisture and ash free (MAF) coal basis. Yields with added ATB-Ceuta crude are compared to the baseline yields using entirely coal derived solvents.

The results show that with the addition of ATB-Ceuta crude in different ratios of ATB-Ceuta crude/coal ranging from about 1/1.7 to 1/3, the $C_5$-900° F. liquid yields have increased from 35.7% (Run 1) to 43.2%, 39.6%, 51.7% and 39.0% for Runs 2, 3, 4 and 5 respectively. The increases are distributed throughout the LD, MD and HD fractions. These four runs have much lower SRC yields, and little higher byproduct gases and $H_2O$ (except Run 3) yields than the baseline run. Other yields, such as hydrogen consumption, $C_1$–$C_4$ formation and IOM (except Run 3) are unaffected by the addition of ATB-Ceuta crude. The data indicates that the ATB-Ceuta crude is a good hydrogen donating solvent under the reaction conditions studied. Surprisingly, the addition of this solvent to a recycle liquefaction process of this type helps significantly to increase $C_5$-900° F. liquid product and decrease SRC yield. Specifically, the product analysis demonstrates that the $C_5$-900° F. liquid yield increased from 35.7% for the baseline run to as high as 51.7% with the addition of ATB-Ceuta crude.

This data, when viewed in conjunction with the data depicted in Table I, indicates that when ATB-Ceuta crude/coal ratio is less than 1/1 and in the presence of process solvent there is an unexpected and significant enhancement of liquid yield. The experiments listed in Table I would indicate that a change in the ratio of ATB-Ceuta crude solvent/coal would have little effect in altering the liquid yield; especially when coupled with the indication that increasing the tetralin/coal ratio significantly enhances liquid yield. In addition, the results using ATB-Ceuta crude in the ratio of ATB-Ceuta crude to coal of greater than 1/1 and without the presence of the coal derived solvent are not particularly surprising, being somewhat less effective than when using tetralin as a solvent.

Accordingly, the combination of process solvent, recycle slurry and a ratio of ATB-Ceuta crude/coal less than about 1/1 provides a particularly effective solvent system for coal liquefaction under the conditions examined herein.

EXAMPLE X

A second series of runs under similar conditions as described in Example IX was carried out assessing the liquefaction of the same Powhatan No. 6 coal and variable amounts of whole Ceuta crude (19 ppm nickel, 142 ppm vanadium), process solvent and recycle slurry.

Results are given in Table III. In view of such results it can be seen that whole crude as the hydrogen donor solvent results in somewhat lower yields of liquid products, as compared to operation with ATB-Ceuta crude. Accordingly, it appears that whole Ceuta crude is a less efficient hydrogen donor solvent than the ATB-Ceuta crude residue.

From the foregoing description and examples, it is apparent that the combination of coal derived and non-coal derived hydrogen donor solvents of the present invention provide a novel, efficient, and relatively inexpensive alternative method for producing liquid petroleum substitutes from coal. The process of the present invention provides a method for transferring large amounts of hydrogen into coal during the liquefaction conversion reaction.

Experiments conducted by the applicants have indicated that in other ways atmospheric tower bottoms are more desirable than whole crude oil fractions. For example, use of whole crude as the hydrogen-donor solvent oftentimes contributes to the formation of coke and propagation of ash from coal and is less effective in coal liquefaction. Moreover, distillation bottoms provide a higher concentration of the catalytic components, V and Ni.

residue by the presence of vanadium and nickel from the extraneous hydrogen donor solvent.

While the invention has been described in terms of preferred embodiments constituting the best mode known to the applicants at the time of this application, it is to be understood that the invention will admit to other embodiments. The description of examples and preferred embodiments is given only to facilitate understanding of the invention by those skilled in the art and should not be construed as limiting the invention itself which is defined by the following claims:

TABLE I

Summary of Experimental Conditions and Results of Coal/ATB-Crude Oil System

| EXAMPLES | I | II | III | IV | V | VI | VII | VIII |
|---|---|---|---|---|---|---|---|---|
| Sample: | Coal/ATB-Ceuta Crude | Coal/Tetralin | Coal | Coal/ATB-Ceuta Crude | Coal/Tetralin | Coal/ATB-Ceuta Crude | Coal/Tetralin | Coal |
| Sample Mass Ratio: | 1/1 | 1/1 | — | ⅓ | ⅓ | 1/1 | 1/1 | — |
| Initial 'Cold' $H_2$ Pressure: | 350 psi | 350 | 350 | 300 | 300 | 300 | 300 | 300 |
| Operating Pressure: | 700 psi | 700 | 700 | 700 | 700 | 700 | 700 | 700 |
| Temperature: | 350° C. | 350 | 350 | 350 | 350 | 400 | 400 | 400 |
| Reaction Time: | 1 hr. | 1 | 1 | 1 | 1 | 1 | 1 | 1 |
| Conversion,[a] Weight % (by Toluene): | 20.2 | 20.8 | 7.6 | 21.3 | 42.3 | 33.4 | 44.2 | 17.8 |
| (by THF): | 25.1 | 26.4 | 21.2 | 24.5 | 16.1 | 16.8 | 26.4 | 15.9 |
| Total: | 45.3 | 47.2 | 28.8 | 45.8 | 58.4 | 50.2 | 70.6 | 33.7 |

[a]Conversion of dry ash free (d.a.f.) coal (wt %) = $\frac{\text{Mass Coal (d.a.f.)} - \text{Mass insoluble (d.a.f.)}}{\text{Mass Coal (d.a.f.)}}$ Further it will be recognized by those familiar with this art, that the processes of this invention are especially advantageous with continuous mode multiple pass recycle processes described in patents issued to Schmid, U.S. Pat. Nos. 4,159,236 and 4,159,238 as well as those process operations described in the Proceedings of the 85th National Meeting of American Institute of Chemical Engineers at Philadelphia, Pa., June 4–8, 1978 by B. K. Schmid and D. M. Jackson, entitled "Recycle SRC Processing for Liquid and Solid Fuels."

Speculative Theory for the Effectiveness of Extraneous Hydrogen Donor Solvent The unexpectedly advantageous result of using non-coal derived hydrogen donor solvent in place of a portion of the coal-derived process solvent probably results from a favorable interaction between the coal-derived process solvent and the extraneous hydrogen donor solvent. In general, the coal-derived liquids provide an effective vehicle for transferring hydrogen from the gas stream to the dissolved coal, but their effectiveness is somewhat limited by the fact that they are relatively low in hydrogen content. The non-coal derived hydrogen donor solvent, on the other hand, can readily supply donatable hydrogen which can be transferred most effectively through the coal-derived solvent to react with the dissolved coal. Thus, the hydrogen donor solvent supplies the added hydrogen, and the coal-derived solvent provides a very effective vehicle for transmittal of the hydrogen to the point of reaction.

This effect is especially advantageous when recycle of product slurry is employed, since the high concentration of mineral residue provides for a high concentration of catalytic activity at the point of reaction to make the most effective use of the hydrogen thus supplied. This effect is further enhanced by the promotion of the normal catalytic activity of the coal-derived mineral

TABLE II

Summary of Product Yields of Powhatan No. 6 Coal with ATB-Ceuta Crude

| Run No. | 1 (Baseline) | 2 | 3 | 4 | 5 | 6 |
|---|---|---|---|---|---|---|
| Slurry Composition, wt % | | | | | | |
| Coal | 30.0 | 30.0 | 30.0 | 30.0 | 30.0 | — |
| Recycle Slurry | 50.9 | 50.9 | 45.9 | 45.9 | 50.9 | — |
| Process Solvent | 19.1 | 9.1 | 9.1 | 6.8 | 6.8 | — |
| ATB-Ceuta Crude | — | 10.0 | 15.0 | 17.3 | 12.3 | 100.0 |
| Yield, wt % (Moisture-Ash-Free) | | | | | | |
| $H_2$ Consumption | 4.1 | 4.0 | 5.1 | 3.6 | 3.9 | 0.3 |
| $C_1$–$C_4$ | 20.3 | 19.5 | 21.2 | 19.6 | 19.3 | 1.8 |
| Byproduct Gas ($H_2S$, CO, $CO_2$) | 3.5 | 4.2 | 4.6 | 4.3 | 4.7 | 0.3 |
| $H_2O$ | 2.4 | 4.5 | 1.1 | 3.7 | 3.7 | — |
| Liquid Yield ($C_5$:483° C.) | 35.7 | 43.2 | 39.6 | 51.7 | 39.0 | 63.3 |
| SRC Yield | 35.4 | 24.9 | 29.2 | 17.1 | 29.3 | 34.8 |
| IOM Yield | 6.8 | 7.5 | 9.4 | 7.2 | 7.9 | 0.2 |

TABLE III

Summary of Product Yields of Powhatan No. 6 Coal with Whole Ceuta Crude

| Run No. | 1 (Baseline) | 2 | 3 |
|---|---|---|---|
| Slurry Composition, wt % | | | |
| Coal | 30.0 | 30.0 | — |
| Recycle Slurry | 50.9 | 40.9 | — |
| Process Solvent | 19.1 | 6.8 | — |
| Whole-Ceuta Crude | — | 22.3 | 100.0 |
| Yield, wt % (Moisture-Ash-Free) | | | |
| $H_2$ Consumption | 3.1 | 4.1 | 0.2 |
| $C_1$–$C_4$ | 18.5 | 25.0 | 4.5 |
| Byproduct Gas ($H_2S$, CO, $CO_2$) | 3.5 | 7.6 | 0.4 |

TABLE III-continued

Summary of Product Yields of Powhatan No. 6 Coal with Whole Ceuta Crude

| Run No. | 1 (Baseline) | 2 | 3 |
|---|---|---|---|
| $H_2O$ | 2.3 | 4.8 | 0.3 |
| Liquid Yield ($C_5$:483° C.) | 35.0 | 32.7 | 88.6 |
| SRC Yield | 36.7 | 25.9 | 6.4 |
| IOM Yield | 7.3 | 8.0 | 0.1 |

What is claimed is:

1. A continuous process for converting solid coal to gaseous and liquid hydrocarbonaceous products comprising:

admixing particulate solid coal, coal derived process solvent, coal derived recycle slurry, and a non-coal derived hydrogen donor solvent consisting essentially of a hydrocarbonaceous oil intrinsically containing greater than about 300 ppm of vanadium plus nickel contaminants, and at least 50% of residuum boiling over 600° F., the admixture having a non-coal derived solvent/coal weight ratio of about 1/1 or less; and reacting said admixture in the absence of an external catalyst source, under hydrogen pressure ranging from about 500 to about 4000 psi and elevated temperature from about 300° C. to about 500° C. for a period of time sufficient to convert a portion of the solid coal to gaseous and liquid hydrocarbonaceous products.

2. The process according to claim 1 wherein the non-coal derived solvent consists essentially of an atmospheric tower bottoms residue of the hydrocarbonaceous oil.

3. The process according to claim 1 wherein the non-coal derived solvent consists essentially of petroleum crude oil.

4. The process according to claim 1 wherein the non-coal derived solvent consists essentially of an atmospheric tower bottoms residue of petroleum crude oil having an initial boiling point of about 600° F. or greater.

5. The process according to claim 1 wherein the non-coal derived solvent is an atmospheric tower bottoms residue from distilled Ceuta crude oil.

6. The process according to claim 1 wherein the non-coal derived solvent has a hydrogen to carbon atomic ratio about 1.4 to about 1.8.

7. The process according to claim 1 wherein the non-coal derived solvent is a vacuum tower bottoms residue.

8. The process according to claim 1 wherein the weight ratio of non-coal derived solvent to coal ranges from about 1/5 to about 1/1.

9. The process according to claim 1 wherein the weight ratio of non-coal derived solvent to coal ranges from about 1/3 to about 1/1.

10. The process according to claim 1 wherein the non-coal derived solvent consists essentially of an atmospheric tower bottoms residue of petroleum crude oil, the solvent having at least 30 ppm nickel and 300 ppm vanadium, a hydrogen/carbon atomic ratio ranging from about 1.4 to about 1.8, and an initial boiling point about 600° F. or greater; and wherein the weight ratio of non-coal derived solvent to coal ranges from about 1/3 to about 1/1.

11. The process according to claim 1 wherein the non-coal derived solvent consists essentially of an atmospheric tower bottoms residue of petroleum crude oil, the solvent having at least 30 ppm nickel and 300 ppm vanadium, a hydrogen/carbon atomic ratio of about 1.6, and an initial boiling point about 600° F. or greater.

* * * * *